US005993244A

United States Patent [19]

Bechaz et al.

[11] Patent Number: 5,993,244

[45] Date of Patent: Nov. 30, 1999

[54] LOOP SPRING ACTIVATED WIRE HOLDING CONNECTOR

[75] Inventors: Bernard Bechaz, Caluire; Sylvain Barrat, Belleville sur Saone, both of France

[73] Assignee: Entrelec S.A., Villeurbanne, France

[21] Appl. No.: 09/048,405

[22] Filed: Mar. 25, 1998

[30] Foreign Application Priority Data

Mar. 28, 1997 [FR] France ..... 97 03853

[51] Int. Cl.[6] ..... H01R 4/24

[52] U.S. Cl. ..... 439/417; 439/789

[58] Field of Search ..... 439/409, 391, 439/389, 387, 417, 436, 789

[56] References Cited

U.S. PATENT DOCUMENTS 1,582,828 4/1926 Kuskin .

FOREIGN PATENT DOCUMENTS 2447620 8/1980 France .
2516711 11/1981 France .
2706482 8/1978 Germany .
3818548 12/1989 Germany .
107924 7/1917 United Kingdom .

*Primary Examiner*—Khiem Nguyen
*Assistant Examiner*—Michael Zarroli
*Attorney, Agent, or Firm*—Ware, Fressola, Van Der Sluys & Adolphson LLP

[57] ABSTRACT

An arrangement including a connection part provided with a slot and a part having one end provided with at least one guide eye for guiding at least one electrical wire, which end can be displaced along a wire-holding slot, the eye being situated beyond an inlet of the slot in an insertion position, in which it is possible to place a wire passing through the eye in front of the inlet of the slot, the eye otherwise being placed at a zone determined by the edges of the slot in another position. The arrangement includes a guide part having a loop spring resiliently returning the end that carries the eye to the wire-holding position by displacing it along the slot. The arrangement is designed to equip electrical equipment modules to which electrical wires are connected in permanent manner.

9 Claims, 2 Drawing Sheets

LOOP SPRING ACTIVATED WIRE HOLDING CONNECTOR

FIELD OF THE INVENTION

The invention relates to a connection arrangement comprising at least one conductive connection part provided with one or more holding slots making it possible to receive one or more electrical wires, and at least one guide part provided with a guide eye for guiding an electrical wire and that can be displaced along a holding slot between two positions, namely a wire-insertion position and a wire-holding position, by external action and/or by the spring effect.

The invention also relates to electrical equipment modules, in particular junction modules, such as, for example, terminal blocks, that are suitable for being equipped with such arrangements.

BACKGROUND OF THE INVENTION

Document FR-A-2 447 620 describes a plurality of electrical wire connection arrangements combining a connection part having a wire-holding slot with a guide part, referred to as an "actuating member", provided with guideways constituted by holes in alignment suitable for receiving a wire. Each actuating member can be displaced along an insulation-displacement and wire-holding slot between two end positions under the effect of external action exerted, for example, by means of a tool shank, such as the shank of a screwdriver, and/or under drive from a spring. Once an actuating member has been displaced into one of its end positions, it is possible to insert a wire, the wire having been positioned in the guideways constituted by aligned holes, in front of an inlet of the holding slot in a position that facilitates insertion of the wire between the edges of the slot. The wire can then be brought by the actuating member between the edges of the slot into a holding zone, after optionally having been subjected to insulation displacement at the inlet of the slot to displace locally an insulating covering that covers its conductive core. The actuating member can then be displaced into the second end position in which the wire remains held via its core which is nipped between the slot edges.

Other connection arrangements, each of which comprises at least one connection part provided with a slot and co-operating with a wire guide part that is mounted to move in translation, the resulting assembly being received in a modular housing and being driveable from outside the housing by means of a tool shank, are known as shown in particular by Document FR-A-2 516 711.

Such an arrangement suffers from the drawback of requiring a relatively large volume in which to house each guide part so as to enable it to be displaced, and also to house the spring in the case of the first above-mentioned document. It is also known, in particular from Document DE-A-2 706 482, that a module, in particular of the terminal block type, can include connection arrangements without guide parts having connection parts formed by looped-over blade springs. Such a spring is placed on a conductive strip and a first end of the spring projects beyond the strip and penetrates into an eye provided in the other end, while bearing against the far edge of the eye because of the resilience of the spring. It is possible to move the first end away from that edge of the eye against which it bears by pressing externally on a curved portion that participates in looping over the spring. A conductive core of a wire to be connected can then be inserted between that edge of the eye against which the wire bears and said first end of the spring, and the wire can then be held by the connection part as soon as the external thrust exerted on the spring is removed.

OBJECTS AND SUMMARY OF THE INVENTION

The invention provides a connection arrangement for one or more conductor wires, the arrangement comprising at least one conductive connection part having one or more slots, each of which serves to hold one or more electrical wires, and at least one guide part, one end of the guide part being provided with at least one eye for guiding at least one electrical wire, and mounted to be displaced along a holding slot between two positions by external action and/or by the spring effect, the eye and any electrical wire guided by it being situated beyond an inlet of said holding slot in an insertion one of said positions, in which it is possible to place a wire passing through the eye in front of said inlet of the holding slot in a position facilitating insertion of the wire between the edges of the slot, the eye and any electrical wire inserted in the eye being situated in a wire-holding zone constituted by the edges of the slot in the other position, after the wire in question has been brought from the insertion position to said other position by the guide part end that is provided with the eye being displaced along the slot.

According to a characteristic of the invention, the arrangement includes a guide part having a loop-type spring resiliently returning the end that carries the eye to the wire-holding position by displacing it along the slot.

According to another characteristic of the invention, the arrangement includes a guide part constituted by a loop spring whose two ends are substantially plane and at least approximately orthogonal to each other, a first one of the ends being provided with at least one guide eye and projecting beyond the other end which bears directly or indirectly against the connection part provided with the slot along which said first end is displaced.

According to another characteristic of the invention, the arrangement includes a spring guide part whose eye is longer than the wire holding zone constituted by the edges of a slot and which is so disposed that the far edge of the eye comes at least to that end of the wire-holding zone which is situated close to the inlet of said slot when that end of the guide-part which is provided with the eye is displaced resiliently to the limit by the spring effect.

According to another characteristic of the invention, the arrangement includes a guide part having a loop-type spring co-operating with a connection part having a slot provided in a planar portion of a conductive strip having a fold beyond which one end of the spring of said guide part bears against said strip.

According to another characteristic of the invention, the arrangement includes a loop-type spring guide part co-operating with a connection part provided with a slot in a hollow shaped-section portion whose cross-section is polygonal in shape and which has an open end against which one end of the spring of the guide part abuts.

According to another characteristic of the invention, the arrangement includes a guide part having a loop-type spring co-operating with a connection part having a slot provided in a plane portion of a conductive strip provided with a fold beyond which a plane end of the spring of said guide part presses against said strip, where the planar end is inserted on assembly between the strip and at least one spring loop positioning element of a housing receiving the arrangement.

According to another characteristic of the invention, the arrangement includes a guide part having a loop-type spring co-operating with a connection part having a slot provided in a hollow shaped-section portion whose cross-section is polygonal in shape, and which has an open end against which a plane end of the spring of said guide part abuts, where said plane end is inserted on assembly between the shaped-section portion and at least one loop spring positioning element of a housing receiving the arrangement.

According to another characteristic of the invention, the arrangement includes a connection part provided with a slot whose edges are shaped to delimit a wire inlet having lips for cutting through the wire covering.

The invention also provides a module, in particular a junction module, including a housing containing an arrangement having at least one of the above-mentioned characteristics.

BRIEF DESCRIPTION OF THE DRAWINGS

The invention, its characteristics, and its advantages are explained in more detail in the following description given with reference to the following figures.

BEST MODE FOR CARRYING OUT THE INVENTION

Figure 1:
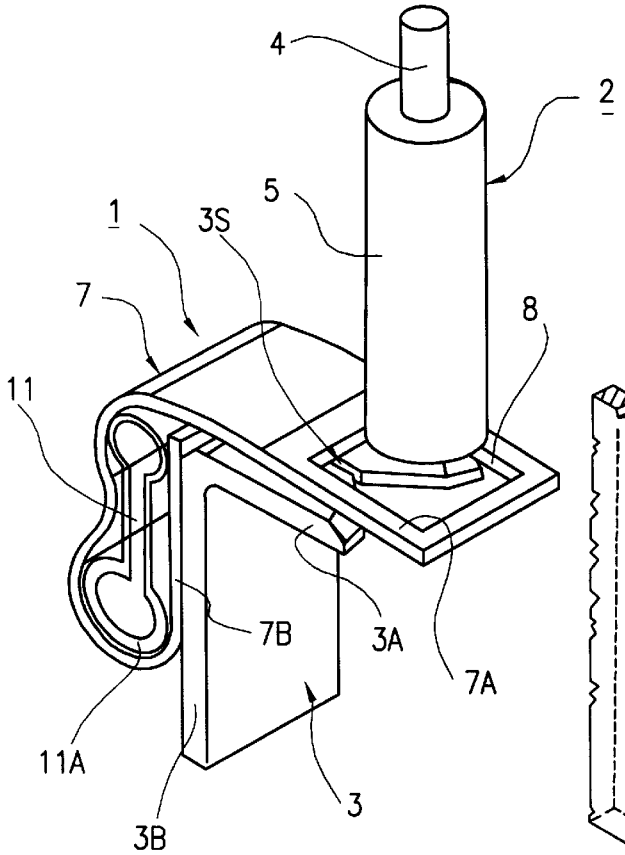
FIGS. 1 and 2 are diagrammatic perspective views of a connection arrangement of the invention with the spring included in the arrangement being shown in two different states.
Figure 2:
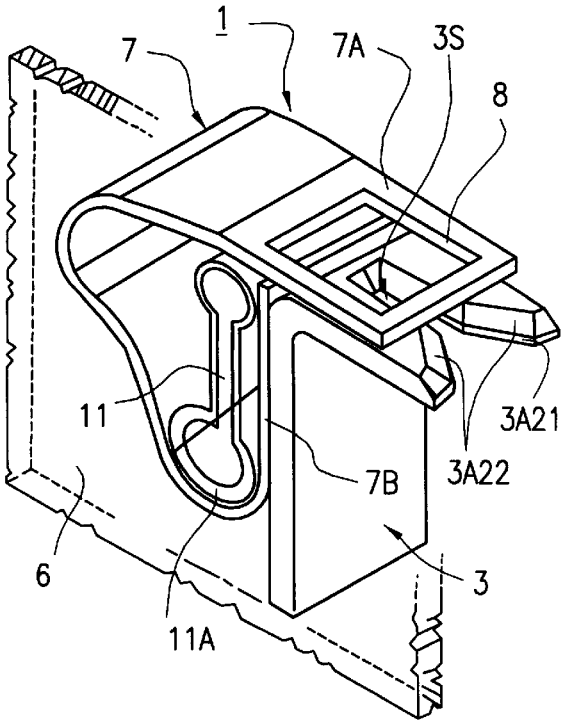

The connection arrangement 1 shown in FIGS. 1 and 2 serves to enable at least one external electrical wire 2 to be electrically connected to a connection part 3 for the purposes of connecting the wire to a portion of an item of electrical equipment (not shown). In the embodiment shown, the connection part 3 is assumed to be constituted by a metal conductive strip, as is conventionally used in an equipment module of the terminal block type for electrically interconnecting identical or similar connection arrangement elements.

In this example, the electrical wire 1 is assumed, to comprise a single-wire or multi-wire conductive core 4 surrounded by an insulating covering 5.

Figure 3:
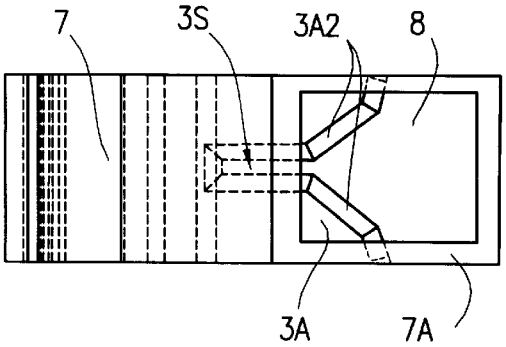
FIGS. 3 and 4 are plan views of the arrangement shown in FIGS. 1 and 2, each view showing a respective one of the above-mentioned states.

The connection part 3 is assumed to be provided with at least one wire-holding slot 35 at one of its ends. In the embodiment shown, this holding slot 35 is organized to open out at one end of the strip constituting the connection part 3 on the longitudinal axis of the portion 3A in which it is situated, as can be seen more clearly in FIGS. 3 and 4. This strip portion 3A provided with a slot is folded, at right angles in this example, relative to the strip portion 3B that it extends. The strip connection part 3 is assumed to be held stationary in a housing, usually made of an insulating material, of the equipment module that includes the arrangement 1, only a portion of the wall 6 of the housing being shown in fragmentary manner in FIG. 2. For example, the strip connection part 3 may be held stationary in a manner known in this field by jamming the strip between pieces of relief (not shown) on the housing, and in particular pieces of relief carried by the wall 6 against which the strip connection part 3 is assumed to be pressed sideways, a wall forming the cover of the housing or of an identical or similar housing serving to complete the task of holding the strip stationary.

Figure 4:
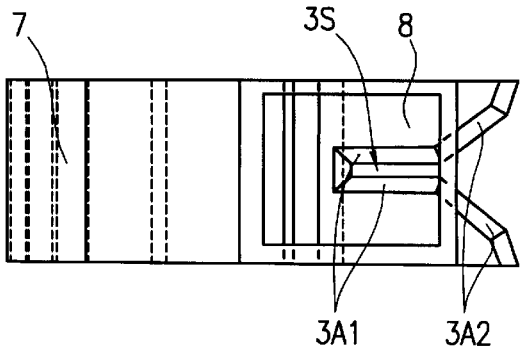

The holding slot 35 provided in the portion 3A is delimited by two parallel edges 3A1 forming a zone for holding a wire core by jamming it, the edges being extended by lips 3A2, as shown in FIG. 4. The lips flare to form a slot inlet via which it is possible to insert a wire core of suitable size into the slot 35, where "size" is conventionally a diameter, and the range of possible sizes is a function, in particular, of the distance between the parallel edges 3A1.

Usually, the lips 3A2 are shaped so as to nick through the covering of a suitable wire 2 on inserting the core of the wire into the slot 35. For example and as shown in FIG. 2, each of them may comprise a plane thin elongate margin 3A21 enabling the core 4 of the wire to be guided when said core comes into contact with a lip, and a bevelled portion 3A22 which extends along the margin 3A21 and which cuts through the covering 5 of the wire when said covering is pushed against it.

As is known, the holding zone formed by the parallel edges 3A1 of a slot 35 has a length that is chosen as a function of the number of wires than can have their cores held firmly in line between the parallel edges.

Provision is made to associate a wire-guide part with the above-mentioned connection part so as to guide a wire appropriately from an insertion position in which the wire is placed appropriately in front of the inlet of the slot 35 to a position in which the core of the wire is held by being jammed between the parallel edges 3A1. As is known, the appropriate wire insertion position is at least ideally such that the wire is orthogonal to the wall 3A in which the slot 35 is provided, and at a height relative to the wall such that the wire covering comes laterally into contact with the lips 3A22 as the wire is moved in translation towards the slot 35 in a direction given by the longitudinal axis of the slot 35.

In accordance with the invention, a guide part 7 having a loop spring is associated with a connection part 3 to form a connection arrangement 1 for one or more conductor wires. In one embodiment, the guide part 7 is constituted by a loop spring, at least one end of which is provided with an eye 8 enabling one or more wires to pass through it depending on needs. The spring may optionally be provided with a plurality of eyes, e.g. in line so as to co-operate with parallel slots of one or more connection parts. Such an embodiment can be deduced easily by a person skilled in the art from the embodiments presented herein, and it is not described in any more detail herein.

The eye 8 may be organized to receive a single wire which it moves from the insertion position in which the wire is placed appropriately in front of the slot 35 inlet to a holding position in which the core of the wire is held between the parallel edges 3A1 by being jammed.

The guide part 7 is then capable of displacing the wire from the insertion position to the holding position and vice versa if the eye is shaped for this purpose. The eye 8 is then constituted by a duct whose length may optionally merely be the thickness of the spring constituting the guide part in the embodiment shown, and whose aperture may take various shapes, and in particular it may be circular, square, rectangular, or slightly oblong. The eye 8 may optionally be provided in an end piece secured to the end of the spring of the guide part 7, it being possible for such an end piece (not shown) to be analogous to the end piece shown in FIG. 1 of above-mentioned document DE-A-2 706 482, which end part is provided with two eyes in alignment that slide along a wire-holding slot on either side of the wall in which the slot is provided.

The eye 8 may also extend over a length that is a function of the length of the core-holding zone determined by the parallel edges 3A1 of the slot 35 in the connection part 3 with which the guide part 7 provided with the eye co-operates, in particular in the variant embodiment shown in FIGS. 5 to 8. Such an eye, whose aperture may be rectangular, as shown, or substantially oblong in shape, may have a length enabling a wire core to penetrate between the parallel edges 3A1 to the holding position that is as far away as possible from the slot inlet, and enabling the eye to return to the position that it had initially, which position is that in which it is possible for the eye to receive a wire to be inserted into the slot in the appropriate insertion position provided for such wires relative to the slot 35 inlet. Such an eye configuration then makes it possible to hold a plurality of wires stationary by successively inserting the cores of the wires into a common slot 35, in which the cores are then jammed in line.

The displacement of the eye 8 of the spring of a guide part 7 relative to a connection part 3 with which the guide part is associated is assumed, in this example, to be organized to take place along a displacement axis that is parallel to the longitudinal axis of the slot 35 with which the connection part is provided in a portion 3A thereof that is assumed to be plane in this example.

It is possible for a person skilled in the art to provide a slot 35 in a portion that is curved instead of being planar, and to make provision for that portion of the guide part in which the eye is provided to move resiliently so as to enable the eye to be displaced along a curve corresponding to that given by the portion in which the slot 35 is provided.

In this embodiment, the eye 8 is provided in a plane end 7A of the spring constituting the guide part 7, the other end 7B of the spring being designed to bear directly or indirectly against the connection part 3 in a manner such that the end 7A can return to a rest position after it has been displaced relative to the connection part by external action.

Provision is made for the spring to be positioned in a predetermined manner relative to the connection part with which it co-operates in a connection arrangement. In the embodiment considered, it is assumed that the wall 6 is provided with at least one piece of positioning relief 11 whose shape is determined in a manner known to a person skilled in the art to enable the spring to work as designed in a space in which it is confined, e.g. with the assistance of the cover-forming wall mentioned above.

In the embodiment shown in FIGS. 1 to 4, the end 7B of the spring is planar and is pressed against the portion 3B of the connection part 3 which is perpendicular to the portion 3A in which the slot is situated, on the other side of the portion 3B from the portion 3A. The spring bears against the portion 3B directly in the embodiment shown. Alternatively, it is possible for the spring to bear via an element, e.g. a piece of relief or a wall optionally projecting from the wall 6 and against which the end 7B of the guide part spring and the connection part 3 then cooperate by sandwiching said element, i.e. a relief or wall, in between the end 7*b* of the guide part spring and the connection part 3.

In the embodiments shown in FIGS. 1 to 8, provision is made for the guide part loop spring to have planar ends 7A and 7B which remain at least substantially orthogonal regardless of the position taken up by the end 7A carrying the eye 8, either naturally under the spring effect, or under the effect of external pressure applied to the spring, e.g. by means of a pusher (not shown) or by means of a tool shank (not shown).

The end 7A is organized to project beyond the other end 7B which is organized to bear against the portion 3B of the connection part, regardless of the displacement of the end 7A, which, as indicated above, makes it possible for the eye 8 to be displaced from an end position in which a wire 2 inserted in the eye can be positioned in front of the inlet of the slot provided in the portion 3A, to a holding end position in which the core of the wire is held between the parallel edges 3A1 of the slot 35, and as far as possible from the slot 35 inlet.

The two ends 7A and 7B of the guide part spring are connected together by an intermediate portion of determined curvature and, in this example, assumed to be made up of a succession of arcuate elements determined in a manner known to a person skilled in the art so that the spring has determined elastic characteristics which are functions of the type of the material constituting the spring, of any treatments applied to the material, and of the shape chosen for the spring. In the example presented, provision is thus made for the spring to comprise three zones having alternate curvatures from one zone to the next, so that a first one of the zones following on from the end portion 7B enables the spring to surround in part a cylindrical bulge 11A in the positioning relief 11, which bulge, in practice, acts as a pin about which the segment of spring including the portion 7A in which the eye 8 is provided can rotate so as to displace said eye. The second zone, whose curvature is the reverse of that of the above-mentioned first zone, co-operates with the third zone which curves in the same direction as the curvature of the first zone to make it possible to displace the end 7A and the eye 8, or at least the far edge of the eye, along the slot provided in the portion 3A in a displacement that is at least substantially parallel to said portion 3A.

In this example, the end 7A is assumed to be resiliently returned to its end position in which the eye 8 is in position above the holding zone delimited by the parallel edges 3A1. External pressure, exerted, for example, in a manner known to a person skilled in the art by means of a tool shank assumed to penetrate into the housing in which the spring, in particular, is housed, so as to press on the third curved zone of the spring so as to push it towards the connection part 3, causes the end 7A to be displaced until the eye 8 is above the inlet of the slot 35 provided in the portion 3A.

It is then possible to insert a wire 2 into the eye and in front of the slot constituted by the lips 3A2.

In the embodiment envisaged, relaxing the external pressure allows the end 7A to return under the spring effect, and causes the core 4 of the wire 2 to be inserted into the slot 35 in which the core reaches either the end holding position in which the spring has resiliently returned to its position of natural equilibrium, or a position in which the core abuts against another wire inserted previously into the same slot, the spring then remaining partially stressed.

As indicated above, it is optionally possible to use displacement of the end 7B in the opposite direction to extract a wire from the slot 35 in which it is jammed, if the length of the eye 8 is chosen to be limited for this purpose in the variant embodiment then envisaged.

FIGS. 5 to 8 relate to a variant embodiment implementing a connection part that is different from the above-described part. The physical elements of this embodiment that can be identical or similar to those in the above-described embodiment retain the same references.

Figure 5:
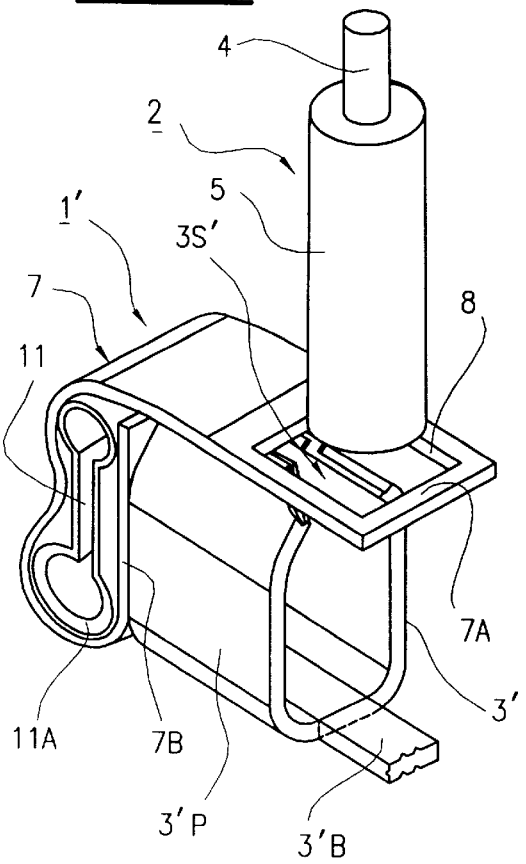
FIGS. 5 and 6 are diagrammatic perspective views of a variant arrangement of the invention, with the spring included in the arrangement being shown in two different states.
Figure 6:
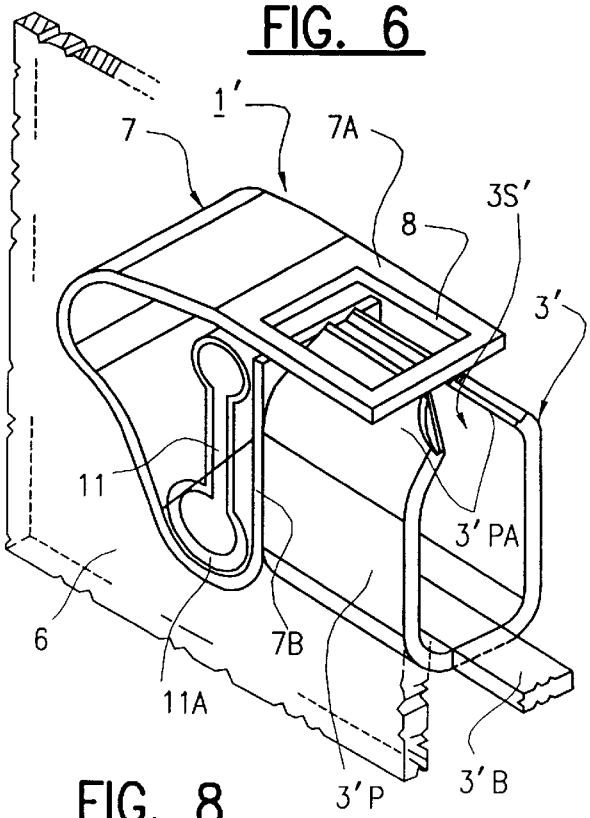
Figure 7:
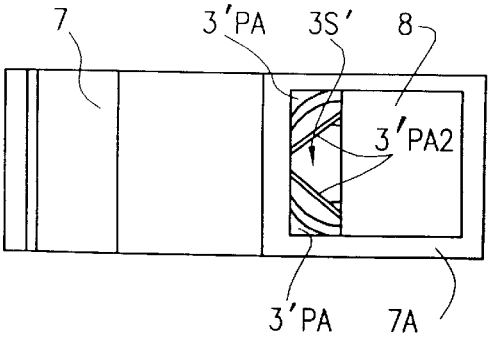
FIGS. 7 and 8 show plan views of the arrangement shown in FIGS. 4 and 5, each view showing a respective one of the above-mentioned states.
Figure 8:
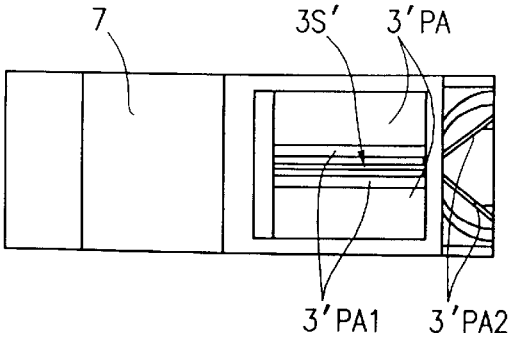

The connection arrangement 1' shown in FIGS. 5 and 6 is designed to enable at least one external electrical wire 2 to be electrically connected to a connection part 3' to connect the wire to a portion of an item of electrical equipment (not shown). In this variant embodiment, the connection part 3' is provided with a wire core holding slot provided with an insulation-displacement inlet for displacing the covering of a wire, the slot having at least approximately the same function as the slot 35 in the above-mentioned connection part 3.

For example, the connection part 3' is of the type of that described in Document EP-A-0 265 321, it can be obtained by cutting out, folding, and locally thinning a plane metal blank, and it has a shaped-section portion 3'P, one face of which is extended by a portion 3'B of the strip type which is shown merely in fragmentary manner in FIGS. 5 and 6.

This strip-forming portion 3'B serves to connect the connection part 3' electrically to a portion of an item of electrical equipment (not shown) as is usual in this field.

For example, the shaped-section portion 3'P may have a hollow polygonal cross-section, which, in this example, is a channel section whose free ends are obliquely and equally folded in towards each other, as shown in FIG. 6. This folding results in two end longitudinal folded margins 3'PA having parallel edges 3'PA1 which define the insulation-displacement and wire core holding zone with which the connection part shaped-section portion 3'P including the folded margins and the edges is provided.

Each of the two parallel walls of the shaped-section portion 3'P unites a respective one of the folded margins 3'PA to a common portion which is extended by the strip-forming portion 3'B in the embodiment proposed.

The two parallel edges of the slot 35 that the folded margins 3'PA form by being folded in towards each other are provided with wire covering displacement lips 3'PA2 obtained, for example, by oblique and symmetrical cutting, then optionally machining the folds to thin them at the same one of the two ends of the shaped-section portion 3'P which includes them, the shaped-section portion delimiting a cavity shown in this example to be open at both of said ends. The other end of the shaped-section portion 3'P is, in this example, designed to serve as an abutment wall for one end 7B of a guide part spring 7 corresponding to the spring mentioned above with reference to FIGS. 1 to 4, and assumed to be a loop spring as above.

In the embodiment considered, the end 7B is plane and closes at least in part the cavity defined by the shaped-section portion 3'P at the end of the portion where it bears against the ends of the walls that surround the cavity.

The connection part 3' is assumed to be held stationary between pieces of relief on a housing of the electrical equipment module that includes the connection arrangement to which the part belongs. The means necessary for holding the part stationary are not described herein insofar as they are well known to a person skilled in art, and insofar as they have only an indirect relationship with the present invention.

The guide part spring 7 is positioned in a determined manner relative to the connection part 3' with which it co-operates in a connection arrangement.

As in the above-described example, it is also assumed in this example that this positioning involves a piece of positioning relief 11 in the housing receiving the connection part 3' and the guide part spring 7 associated therewith. The shape of the relief 11 is as in the preceding example to enable the spring to work in a space in which it is confined, the space being provided, for example, between the wall 6 and a cover-forming wall analogous to the wall mentioned in the description of the embodiment shown summarily in FIGS. 1 to 4.

In this example, the guide part spring 7 is shown bearing against the end of the shaped-section portion 3'P via a plane end 7B of the spring which bears directly against the shaped-section portion 3'P. As indicated above, the spring may bear indirectly against the shaped-section portion if a physical element such as a housing wall (not shown) is interposed between the end 7B of the guide part spring and the end of the shaped-section portion against which said end of the spring bears.

As in the above-mentioned embodiment, the other end 7A of the spring is assumed to be plane and provided with an eye 8 having at least approximately the same characteristics as the above-mentioned eye.

In particular, provision is made so that that end 7A of the guide part spring in which the eye 8 is provided can be displaced along the slot 35 in the shaped-section portion 3'P of the part 3' between two position, one of the positions enabling a wire 2 to be inserted into the eye 8 in the appropriate insertion position in front of the slot 35 inlet constituted by the lips 3'PA2, the other position being the far holding position in which a wire can be held by jamming the core of the wire between the parallel edges 3'PA1 of the slot 35 in the shaped-section portion 3'P. As indicated above with reference to the embodiment shown in FIGS. 1 to 4, the eye 8 can be organized to receive one or more wires in line.

The construction and operating details that are common to both of the embodiments presented are not reproduced insofar as this is clearly not absolutely necessary.

Naturally, it is to be understood that the arrangement of the invention may be implemented in a large number of applications in which it is necessary to connect one or more electrical wires to equipment housed at least in part in a housing optionally constituting a single module if the apparatus is independent, but also, alternatively, that can be combined with at least one other module, e.g. an identical, similar, or compatible, module, such as, for example, a module of the terminal block or connector unit type. Such modules are not described in any more detail herein insofar as firstly they can have various shapes and secondly the documents mentioned in the present description constitute examples of such modules.

We claim:

1. A connection arrangement for one or more conductor wires, the connection arrangement comprising:

at least one conductive connection part having one or more holding slots, each holding slot having opposing wire holding edges and a flared wire receiving inlet that respectively hold and receive one or more electrical wires, and at least one guide part, one end of the guide part having at least one eye for guiding at least one electrical wire, and mounted to be displaced along a holding slot between an insertion position and a wire-holding position by application of an external force, an eye and an electrical wire that is received and guided by the eye being situated beyond the flared wire receiving inlet of said holding slot when the connection arrangement is in the insertion position so that the electrical wire passing through the eye in front of said flared wire receiving inlet of the holding slot is in a position facilitating insertion of the electrical wire between the opposing wire holding edges of the holding slot, and so that the eye and the electrical wire inserted in the eye being situated in a wire-holding zone constituted by the opposing wire holding edges of the holding slot when the connection arrangement is in the wire-holding position, the guide part having a loop spring resiliently returning the end that carries the eye to the wire-holding position by displacing it along the holding slot when the connection arrangement does not have an external force applied thereto.

2. An arrangement according to claim 1, including a guide part constituted by a loop spring whose two ends are substantially planar and at least approximately orthogonal to each other, a first one of the ends being provided with at least one guide eye and projecting beyond the other end which bears directly or indirectly against the connection part provided with the slot along which said first end is displaced.

3. An arrangement according to claim 1, including a spring guide part whose eye is longer than the wire holding zone constituted by the edges of a slot and which is so disposed that the far edge of the eye comes at least to that end of the wire-holding zone which is situated close to the inlet of said slot when that end of the guide-part which is provided with the eye is displaced resiliently to the limit by the spring effect.

4. An arrangement according to claim 1, including a guide part having a loop-type spring co-operating with a connection part having a slot provided in a planar portion of a conductive strip having a fold beyond which one end of the spring of said guide part bears against said strip.

5. An arrangement according to claim 1, including a loop spring guide part co-operating with a connection part provided with a slot in a hollow shaped-section portion whose cross-section is polygonal in shape and which has an open end against which one end of the spring of the guide part abuts.

6. An arrangement according to claim 4, including a guide part having a loop spring co-operating with a connection part having a slot provided in a planar portion of a conductive strip provided with a fold beyond which a planar end of the spring of said guide part presses against said strip, where the planar end is inserted on assembly between the strip and at least one spring loop positioning element of a housing receiving the arrangement.

7. An arrangement according to claim 5, including a guide part having a loop spring co-operating with a connection part having a slot provided in a hollow shaped-section portion whose cross-section is polygonal in shape, and which has an open end against which a planar end of the spring of said guide part abuts, where said plane end is inserted on assembly between the shaped-section portion and at least one spring loop positioning element of a housing receiving the arrangement.

8. An arrangement according to claim 1, including a connection part provided with a slot whose edges are shaped to delimit a wire inlet having lips for cutting through the wire covering.

9. A connection arrangement according to claim 1, wherein the holding slot has substantially parallel wire holding edges dimensioned for holding the at least one electrical wire.

* * * * *

UNITED STATES PATENT AND TRADEMARK OFFICE

CERTIFICATE OF CORRECTION

PATENT NO : 5,993,244

DATED : November 30, 1999

INVENTOR(S) : Bernard Bechaz, Sylvain Barrat

It is certified that error appears in the above-identified patent and that said Letters Patent is hereby corrected as shown below:

At column 2, line 26, delete "loop-type spring" and insert --loop spring--.

Line 46, delete "loop-type spring" and insert --loop spring--.

Line 52, delete "loop-type spring" and insert --loop spring--.

Line 59, delete "loop-type spring" and insert --loop spring--.

Line 61, delete "plane portion" and insert --planar portion--.

Line 67, delete "loop-type spring" and insert --loop spring--.

At column 3, line 54, delete "35" and insert --3S--.

Line 55, delete "35" and insert --3S--.

Line 61, delete "strip".

Line 66, delete "strip".

At column 4, line 2, delete "strip".

Line 6, delete "35" and insert --3S--.

Line 11, delete "35" and insert --3S--.

UNITED STATES PATENT AND TRADEMARK OFFICE

CERTIFICATE OF CORRECTION

PATENT NO : 5,993,244

DATED : November 30, 1999

INVENTOR(S) : Bernard Bechaz, Sylvain Barrat

It is certified that error appears in the above-identified patent and that said Letters Patent is hereby corrected as shown below:

At column 4, line 16, delete "35" and insert --3S--.

Line 24, delete "35" and insert --3S--.

Line 31, delete "35" and insert --3S--.

Line 36, delete "35" and insert --3S--.

Line 38, delete "35" and insert --3S--.

Line 39, delete "35" and insert --3S--.

Line 54, delete "35" and insert --3S--.

At column 5, line 7, delete "35" and insert --3S--.

Line 18, delete "35" and insert --3S--.

Line 21, delete "35" and insert --3S--.

Line 27, delete "35" and insert --3S--.

Line 31, delete "35" and insert --3S--.

Line 35, delete "35" and insert --3S--.

Line 55, after "slot" insert --3S--.

UNITED STATES PATENT AND TRADEMARK OFFICE

CERTIFICATE OF CORRECTION

PATENT NO : 5,993,244

DATED : November 30, 1999

INVENTOR(S) : Bernard Bechaz, Sylvain Barrat

It is certified that error appears in the above-identified patent and that said Letters Patent is hereby corrected as shown below:

At column 6, line 11, after "slot" insert --3S--.

Line 13, delete "35" and insert --3S--.

Line 14, delete "35" and insert --3S--.

Line 47, delete "35" and insert --3S--.

Line 52, delete "35" and insert --3S--.

Line 60, delete "35" and insert --3S--.

At column 7, line 9, delete "35" and insert --3S--.

Line 33, delete "35" and insert --3S'--.

At column 8, line 19, delete "35" and insert --3S'--.

Line 22, delete "35" and insert --3S'--.

Line 26, delete "35" and insert --3S'--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*